US008465606B1

(12) United States Patent
Redding et al.

(10) Patent No.: US 8,465,606 B1
(45) Date of Patent: Jun. 18, 2013

(54) COMPOSITION OF MATTER FOR AN INCENDIARY DEVICE AND METHOD OF MANUFACTURE

(75) Inventors: David R. Redding, Edgewood, MD (US); Gene V. Tracy, Jarrettsville, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 734 days.

(21) Appl. No.: 12/355,348

(22) Filed: Jan. 16, 2009

(51) Int. Cl.
*C06B 23/00* (2006.01)
*D03D 23/00* (2006.01)

(52) U.S. Cl.
USPC ..... 149/37; 149/109.6

(58) Field of Classification Search
USPC ..... 149/37, 109.6
See application file for complete search history.

(56) References Cited

U.S. PATENT DOCUMENTS

| | | | | |
|---|---|---|---|---|
| 5,698,812 | A | 12/1997 | Song | |
| 6,766,744 | B1 * | 7/2004 | Song et al. | 102/364 |
| 2001/0054462 | A1 * | 12/2001 | Hagel et al. | 149/24 |

* cited by examiner

*Primary Examiner* — Aileen B Felton
(74) *Attorney, Agent, or Firm* — Ulysses John Biffoni

(57) ABSTRACT

A composition of matter for an incendiary device includes a thermate component consisting of strontium nitrate Gr A, black iron oxide Gr B, aluminum Gr D Cl 5, aluminum Gr E Cl 6, sulfur Gr E, and polyacrylic rubber; and an ignition component consisting of potassium nitrate, titanium, aluminum, silicon, sulfur, charcoal, and polyacrylic rubber, wherein the thermate component consists of a barium nitrate free thermate formulation, and wherein the ignition component consists of a lead free ignition formulation. A parts by weight composition of the thermate component consists of 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber, and a parts by weight composition of the ignition component consists of 66% potassium nitrate, 11% titanium, 8% aluminum, 6% silicon, 2% sulfur, 5% charcoal, and 2% polyacrylic rubber. Preferably, the first and second components are consolidated together using a ram having a sharp-edged profile.

17 Claims, 1 Drawing Sheet

COMPOSITION OF MATTER FOR AN INCENDIARY DEVICE AND METHOD OF MANUFACTURE

GOVERNMENT INTEREST

The invention described herein may be manufactured, used, and/or licensed by or for the United States Government.

BACKGROUND

1. Technical Field

The embodiments herein generally relate to incendiary devices, and more particularly, to compositions of matter for use in an incendiary device.

2. Description of the Related Art

The conventional AN-M14 configuration has a history of cold weather failure. Specifically, during testing the grenades underwent rapid deflagration blowing apart the item. This event poses a significant personnel and equipment hazard. The conventional thermate formulation containing the toxic substance barium nitrate is shown in Table 1. Barium nitrate was used at the time of initial formulation because there was little concern about the toxicity of components in the formulation.

TABLE 1

Thermate formulation

| Component | Parts by weight % |
|---|---|
| Aluminum Type II Gr D Cl 5 | 16 |
| Aluminum Type II Gr C Cl 4 | 9 |
| Black Iron Oxide | 44 |
| Barium Nitrate | 29 |
| Sulfur | 2 |

The conventional ignition formulation in parts by weight for the AN-M14 thermate grenade containing lead is shown in Table 2:

TABLE 2

Ignition formulation

| Component | Parts by weight % |
|---|---|
| Titanium Powdered | 25 |
| Red Iron Oxide | 25 |
| Silicon | 25 |
| Red Lead | 25 |

The final increment of the conventional formulation is consolidated using a ram with a curved profile. This curved profile of the ram given to the consolidated composition is more efficient at dissipating the heat from an ignition source than one that is made up of sharp edges.

SUMMARY

In view of the foregoing, an embodiment of the invention provides a composition of matter for an incendiary device, the composition of matter comprising a first component comprising a barium nitrate free thermate formulation; and a second component comprising a lead free ignition formulation. The first component comprises active ingredients consisting of strontium nitrate Gr A, black iron oxide Gr B, aluminum Gr D Cl 5, aluminum Gr E Cl 6, sulfur Gr E, and polyacrylic rubber. "Gr" and "Cl" refer to the grade and class of the material, respectively, and are well known standards used in the military and pyrotechnic industries. A parts by weight composition of the active ingredients of the first component preferably comprises 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber. The second component comprises active ingredients consisting of potassium nitrate, titanium, aluminum, silicon, sulfur, charcoal, and polyacrylic rubber. A parts by weight composition of the active ingredients of the second component comprises 66% potassium nitrate, 11% titanium, 8% aluminum, 6% silicon, 2% sulfur, 5% charcoal, and 2% polyacrylic rubber. Moreover, the first component and the second component are consolidated together using a ram having a sharp edged profile. The incendiary device may comprise an AN-M14 thermate grenade.

Another embodiment provides a method of forming a composition of matter for an incendiary device, the method comprising providing a first component comprising a barium nitrate free thermate formulation; providing a second component comprising a lead free ignition formulation; and consolidating the first component with the second component. The first component comprises active ingredients consisting of strontium nitrate Gr A, black iron oxide Gr B, aluminum Gr D Cl 5, aluminum Gr E Cl 6, sulfur Gr E, and polyacrylic rubber. A parts by weight composition of the active ingredients of the first component comprises 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber. The second component comprises active ingredients consisting of potassium nitrate, titanium, aluminum, silicon, sulfur, charcoal, and polyacrylic rubber. A parts by weight composition of the active ingredients of the second component comprises 66% potassium nitrate, 11% titanium, 8% aluminum, 6% silicon, 2% sulfur, 5% charcoal, and 2% polyacrylic rubber. Preferably, the consolidating the first component with the second component occurs using a ram having a sharp edged profile. Furthermore, the incendiary device may comprise an AN-M14 thermate grenade.

Another embodiment provides a composition of matter for an incendiary device, the composition of matter comprising a thermate component consisting of strontium nitrate Gr A, black iron oxide Gr B, aluminum Gr D Cl 5, aluminum Gr E Cl 6, sulfur Gr E, and polyacrylic rubber; and an ignition component consisting of potassium nitrate, titanium, aluminum, silicon, sulfur, charcoal, and polyacrylic rubber, wherein the thermate component consists of a barium nitrate free thermate formulation, and wherein the ignition component consists of a lead free ignition formulation. A parts by weight composition of the thermate component consists of 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber, and a parts by weight composition of the ignition component consists of 66% potassium nitrate, 11% titanium, 8% aluminum, 6% silicon, 2% sulfur, 5% charcoal, and 2% polyacrylic rubber. Preferably, the thermate component and the ignition component are consolidated together using a ram having a sharp edged profile. Additionally, the incendiary device may comprise an AN-M14 thermate grenade.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

The embodiments herein will be better understood from the following detailed description with reference to the drawings, in which.

DETAILED DESCRIPTION OF PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Figure 2:
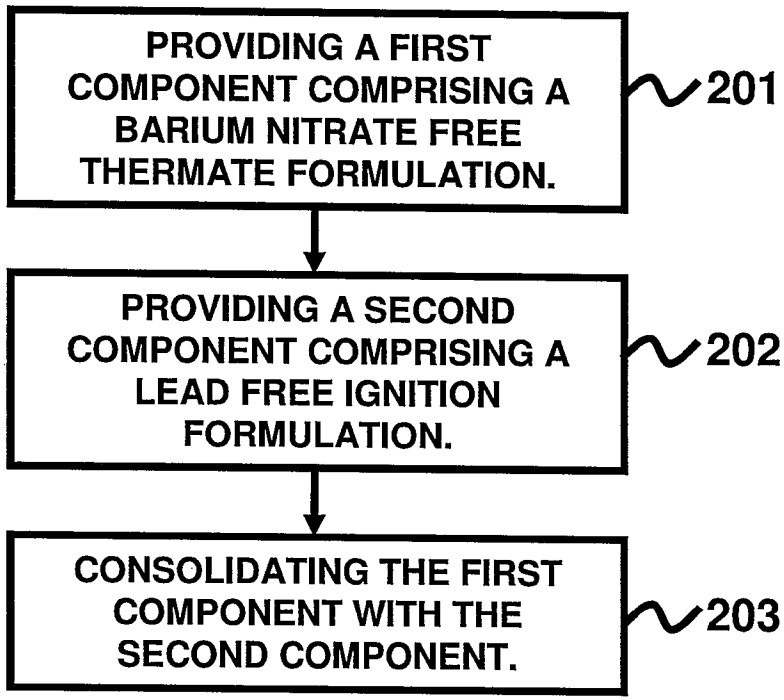
FIG. 2 is a flow diagram illustrating a method according to an embodiment herein.
Figure 1:
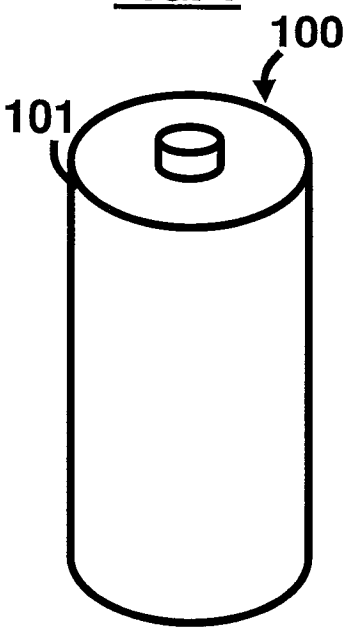
FIG. 1 is a schematic diagram illustrating a ram used in accordance with the embodiments herein.

The embodiments herein provide a reconfigured AN-M14 thermate grenade that increases cold temperature reliability and performance. The reconfigured AN-M14 thermate grenade provided by the embodiments herein also removes toxic constituents making this formulation safer to manufacture and more environmentally friendly. Referring now to the drawings, and more particularly to FIGS. 1 and 2, where similar reference characters denote corresponding features consistently throughout the figures, there are shown preferred embodiments.

It has been determined that the absence of a binder in the conventional formulations described in Tables 1 and 2 contributes to the cold functioning problems experienced. Without a binder, rough handling and temperature cycling causes the grain of the composition to crack. This cracking results in a larger surface area for the reaction to occur. When the reaction rate becomes too great, the munition can explode; potentially injuring those in the area. Another reason for the cold weather failures is the method utilized for consolidating the conventional final increment. By creating a surface profile containing sharp edges, the ignition stimulus is better focused resulting in a more reliable ignition transfer.

The embodiments herein provide a barium nitrate free thermate formulation which is provided in Table 3.

TABLE 3

Barium nitrate free thermate formulation

| Component | Parts by weight % |
|---|---|
| Strontium Nitrate Gr A | 20.59 |
| Black Iron Oxide Gr B | 48.04 |
| Aluminum Gr D Cl 5 | 17.57 |
| Aluminum Gr E Cl 6 | 9.88 |
| Sulfur Gr E | 1.96 |
| Polyacrylic Rubber | 1.96 |

The addition of a binder to the formulation helps to maintain the grain integrity of the composition during temperature cycling as well as increase overall durability of the item. The added binder increases the plasticity of the composition allowing for expansion and contraction while maintaining the integrity of the grain and preventing cracking. Increased plasticity also helps to increase the ability of the item to absorb shock without permanent grain deformation. The lead free ignition formulation is shown in Table 4.

TABLE 4

Lead free ignition formulation

| Component | Parts by weight % |
|---|---|
| Potassium Nitrate | 66 |
| Titanium | 11 |
| Aluminum | 8 |
| Silicon | 6 |
| Sulfur | 2 |
| Charcoal | 5 |
| Polyacrylic Rubber | 2 |

Consolidation in accordance with the embodiments herein is accomplished using a ram 100 (as shown in FIG. 1) with sharp edges 101 to facilitate ignition transfer. The embodiments herein aid in enhancing the AN-M14 grenade performance as well as lowering overall toxicity. The performance is enhanced by the addition of a polyacrylic rubber binder as well as by using a ram profile with sharp edges 101 during consolidation for increased ignition transfer. The consolidation process occurs as follows: the first two increments are placed in a consolidation device 100 (e.g., sharp-edged ram) and contain 250 grams of the thermate. The first two increments are consolidated using a flat faced ram (not shown). All increments are consolidated under a force of 15,000 pounds dead load with a dwell time of approximately five seconds. The third increment contains 200 grams of thermate followed by twenty grams of ignition composition. The thermate and ignition compositions are pressed in a single increment in an effort to increase the intimacy of contact thereby increasing the reliability of ignition transfer.

The sharp edges 101 of the ram 100 reduce the cross-sectional contact area thereby reducing the rate at which heat can be conducted away from the ignition site. Less heat conduction away from the ignition site results in an increased temperature and therefore increases the likelihood of ignition transfer.

The embodiments herein remove barium nitrate from the thermate composition and remove lead from the ignition composition. The removal of these constituents makes the AN-M14 grenade more environmentally friendly during use, increases performance, as well as less toxic to manufacture.

FIG. 2 is a flow diagram illustrating a method of forming a composition of matter for an incendiary device, the method comprising providing (201) a first component comprising a barium nitrate free thermate formulation; providing (202) a second component comprising a lead free ignition formulation; and consolidating (203) the first component with the second component. The first component comprises active ingredients consisting of strontium nitrate Gr A, black iron oxide Gr B, aluminum Gr D Cl 5, aluminum Gr E Cl 6, sulfur Gr E, and polyacrylic rubber. A parts by weight composition of the active ingredients of the first component comprises 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber. The second component comprises active ingredients consisting of potassium nitrate, titanium, aluminum, silicon, sulfur, charcoal, and polyacrylic rubber. A parts by weight composition of the active ingredients of the second component comprises 66% potassium nitrate, 11% titanium, 8% aluminum, 6% silicon, 2% sulfur, 5% charcoal, and 2% polyacrylic rubber. Preferably, the consolidating the first component with the second component occurs using a ram 100 having a sharp edged profile 101. Furthermore, the incendiary device may comprise an AN-M14 thermate grenade.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A composition of matter for an incendiary device, said composition of matter comprising:

a first component comprising a barium nitrate free thermate formulation; and a second component comprising a lead free ignition formulation.

2. The composition of matter of claim 1, wherein said first component comprises active ingredients consisting of strontium nitrate Gr A, black iron oxide Gr B, aluminum Gr D Cl 5, aluminum Gr E Cl 6, sulfur Gr E, and polyacrylic rubber.

3. The composition of matter of claim 2, wherein a parts by weight composition of said active ingredients comprises 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber.

4. The composition of matter of claim 1, wherein said second component comprises active ingredients consisting of potassium nitrate, titanium, aluminum, silicon, sulfur, charcoal, and polyacrylic rubber.

5. The composition of matter of claim 4, wherein a parts by weight composition of said active ingredients comprises 66% potassium nitrate, 11% titanium, 8% aluminum, 6% silicon, 2% sulfur, 5% charcoal, and 2% polyacrylic rubber.

6. The composition of matter of claim 1, further comprising consolidating said first component and said second component together using a ram having a sharp edged profile.

7. A method of forming a composition of matter for an incendiary device, said method comprising:

providing a first component comprising a barium nitrate free thermate formulation;

providing a second component comprising a lead free ignition formulation; and consolidating said first component with said second component.

8. The method of claim 7, wherein said first component comprises active ingredients consisting of strontium nitrate Gr A, black iron oxide Gr B, aluminum Gr D Cl 5, aluminum Gr E Cl 6, sulfur Gr E, and polyacrylic rubber.

9. The method of claim 8, wherein a parts by weight composition of said active ingredients comprises 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber.

10. The method of claim 7, wherein said second component comprises active ingredients consisting of potassium nitrate, titanium, aluminum, silicon, sulfur, charcoal, and polyacrylic rubber.

11. The method of claim 10, wherein a parts by weight composition of said active ingredients comprises 66% potassium nitrate, 11% titanium, 8% aluminum, 6% silicon, 2% sulfur, 5% charcoal, and 2% polyacrylic rubber.

12. The method of claim 7, wherein the consolidating said first component with said second component occurs using a ram having a sharp edged profile.

13. A composition of matter for an incendiary device, said composition of matter comprising:

a thermate component consisting of strontium nitrate Gr A, black iron oxide Gr B, aluminum Gr D Cl 5, aluminum Gr E Cl 6, sulfur Gr E, and polyacrylic rubber; and an ignition component consisting of potassium nitrate, titanium, aluminum, sulfur, charcoal, and polyacrylic rubber.

14. The composition of matter of claim 13, wherein said thermate component consists of a barium nitrate free thermate formulation, and wherein said ignition component consists of a lead free ignition formulation.

15. The composition of matter of claim 13, wherein a parts by weight composition of said thermate component consists of 20.59% strontium nitrate Gr A, 48.04% black iron oxide Gr B, 17.57% aluminum Gr D Cl 5, 9.88% aluminum Gr E Cl 6, 1.96% sulfur Gr E, and 1.96% polyacrylic rubber.

16. The composition of matter of claim 13, wherein a parts by weight composition of said ignition component consists of 66% potassium nitrate, 11% titanium, 8 aluminum, 6% silicon, 2% sulfur, 5% charcoal, and 2% polyacrylic rubber.

17. The composition of matter of claim 13, wherein said thermate component and said ignition component are consolidated together using a ram having a sharp edged profile.

* * * * *